US011286641B2

(12) United States Patent
Mahrenholz et al.

(10) Patent No.: US 11,286,641 B2
(45) Date of Patent: Mar. 29, 2022

(54) ATTACHMENT-CONFIGURABLE SYSTEM FOR A WORK MACHINE

(71) Applicant: DEERE & COMPANY, Moline, IL (US)

(72) Inventors: John Mahrenholz, Dubuque, IA (US); Brett Graham, Dubuque, IA (US); Alex Vandegrift, Dubuque, IA (US); Nicholas Rokusek, Dubuque, IA (US); Christopher Meyer, Asbury, IA (US)

(73) Assignee: Deere & Company, Moline, IL (US)

( * ) Notice: Subject to any disclaimer, the term of this patent is extended or adjusted under 35 U.S.C. 154(b) by 558 days.

(21) Appl. No.: 16/213,846

(22) Filed: Dec. 7, 2018

(65) Prior Publication Data

US 2020/0181876 A1 Jun. 11, 2020

(51) Int. Cl.
*E02F 3/96* (2006.01)
*E02F 9/16* (2006.01)
(Continued)

(52) U.S. Cl.
CPC ..... *E02F 3/962* (2013.01); *E02F 3/3609* (2013.01); *E02F 9/14* (2013.01); *E02F 9/163* (2013.01); *E02F 9/2004* (2013.01)

(58) Field of Classification Search
CPC ... E02F 3/962; E02F 9/14; E02F 9/163; E02F 3/3609; E02F 9/2004; E02F 3/34;
(Continued)

(56) References Cited

U.S. PATENT DOCUMENTS 2,959,306 A * 11/1960 Kampert ..... E02F 3/3411 414/713
4,844,685 A * 7/1989 Sagaser ..... E02F 3/43 414/700
(Continued)

FOREIGN PATENT DOCUMENTS

CA 2885399 A1 9/2016
DE 102005019820 A1 1/2006
(Continued)

OTHER PUBLICATIONS

German Search Report issued in counterpart application No. 102019219178.9 dated Sep. 23, 2020 (10 pages).

*Primary Examiner* — Edwin J Toledo-Duran

(57) ABSTRACT

An attachment-configurable control system and method for a work machine, the work machine comprising a frame and a ground-engaging mechanism; a boom assembly coupled to the frame and moveable relative to the frame by a pair of first hydraulic cylinders, and an attachment coupler coupled to a distal section of the boom arms, the attachment coupler moveable relative to the frame by a pair of second hydraulic cylinders; an operator cab coupled to the frame, the operator cab comprising a joystick configured to move in at least a first direction, and at least a second direction wherein the second direction is transverse to the first direction; and a controller enabling an operator to command movement of a first attachment coupled to the boom assembly using a first movement command configuration a second attachment coupled to the boom assembly using a second movement command configuration.

20 Claims, 10 Drawing Sheets

(51) Int. Cl.
*E02F 3/36* (2006.01)
*E02F 9/14* (2006.01)
*E02F 9/20* (2006.01)

(58) Field of Classification Search
CPC ..... E02F 3/43; E02F 3/961; E02F 3/36; E02F 3/40; E02F 3/42; E02F 3/38; E02F 5/06; E02F 5/14; E02F 3/382; E02F 3/815; E02F 9/2235; E02F 3/844; E02F 9/2271; E02F 3/28; E02F 3/76; E02F 3/80; E02F 3/841; E02F 3/96; E02F 9/2012; E02F 9/26; E02F 9/2029; E02F 3/435; E02F 9/264; E02F 9/2041; E02F 5/145; E21B 7/02; G05B 19/106; G05B 2219/23425; A01B 69/007; A01B 63/00; A01B 69/001; A01B 63/24; B60L 2260/26
USPC ..... 701/19, 50
See application file for complete search history.

(56) References Cited

U.S. PATENT DOCUMENTS 5,169,277 A 12/1992 Orser et al.
5,931,254 A * 8/1999 Loraas ..... E02F 9/24 180/272
6,061,617 A * 5/2000 Berger ..... A01B 63/10 700/18
6,152,239 A * 11/2000 Kelley ..... E02F 3/841 172/4.5
6,293,033 B1 * 9/2001 Moriya ..... E02F 9/2012 37/348
6,447,240 B1 * 9/2002 Cain ..... E02F 3/435 33/710
6,542,789 B2 * 4/2003 Ufheil ..... G05B 19/04 700/275
6,550,562 B2 * 4/2003 Brandt ..... E02F 9/2004 180/333
6,892,822 B2 * 5/2005 Mieger ..... E02F 3/3654 172/272
7,036,248 B2 * 5/2006 Meyeres ..... E02F 9/2004 172/2
7,099,722 B2 * 8/2006 Casey ..... E02F 3/96 700/188
7,451,840 B2 * 11/2008 Radke ..... B60G 21/073 180/9.44
8,091,678 B2 * 1/2012 Rowan ..... B60N 2/753 180/320
8,108,109 B2 1/2012 Young et al.
8,118,111 B2 * 2/2012 Armas ..... E02F 3/7618 172/779
8,521,371 B2 * 8/2013 Faivre ..... G05B 19/106 701/50
8,768,577 B2 7/2014 Lougheed et al.
9,055,719 B2 * 6/2015 Bowman ..... A01G 23/006
9,328,479 B1 * 5/2016 Rausch ..... E02F 3/847
9,340,956 B2 * 5/2016 Dilts ..... E02F 3/432
9,988,786 B2 6/2018 Martin et al.
10,533,300 B1 * 1/2020 Armas ..... E02F 3/3414
10,676,900 B2 * 6/2020 Hiekata ..... E02F 3/963
2002/0070069 A1 * 6/2002 Brandt ..... E02F 9/2004 180/333
2006/0064221 A1 * 3/2006 Sporer ..... E02F 9/2012 701/50
2006/0123673 A1 * 6/2006 Glover ..... E02F 3/847 37/348
2008/0083570 A1 * 4/2008 Bares ..... E02F 9/2004 180/6.48
2008/0184841 A1 * 8/2008 Blind ..... G05G 9/047 74/491
2008/0300758 A1 * 12/2008 Young ..... E02F 9/225 701/50
2009/0038186 A1 * 2/2009 Osswald ..... E02F 3/96 37/413
2009/0118844 A1 * 5/2009 Schmuck ..... E02F 9/264 700/83
2009/0198409 A1 * 8/2009 Rector ..... G07C 5/085 701/33.4
2009/0198414 A1 * 8/2009 Mohning ..... B62D 1/12 701/41
2013/0274925 A1 10/2013 Oates, Jr. et al.
2014/0105713 A1 * 4/2014 Dilts ..... E02F 3/422 414/685
2015/0159342 A1 * 6/2015 Martin ..... E02F 3/3405 414/697
2015/0225923 A1 * 8/2015 Wallace ..... G01C 15/002 701/50
2015/0275469 A1 * 10/2015 Fredrickson ..... E02F 3/3414 414/685
2016/0032564 A1 * 2/2016 Pinther, II ..... E02F 3/3414 60/327
2016/0230367 A1 * 8/2016 Hendron ..... E02F 3/7627
2016/0273196 A1 * 9/2016 Funk ..... E02F 3/437
2017/0107698 A1 * 4/2017 Yamaguchi ..... H04N 7/181
2017/0145655 A1 * 5/2017 Mason ..... E02F 3/7618
2017/0284316 A1 * 10/2017 Hansen ..... E02F 9/2232
2017/0300040 A1 10/2017 Butler
2018/0030693 A1 * 2/2018 Padilla ..... E02F 9/24
2018/0058038 A1 * 3/2018 Fredrickson ..... G05G 9/047
2018/0106011 A1 * 4/2018 Kumbhar ..... E02F 3/3405
2018/0179735 A1 * 6/2018 Newlin ..... F15B 21/02
2018/0245306 A1 8/2018 Lewis
2019/0226176 A1 * 7/2019 Smith ..... E02F 3/432
2020/0102717 A1 * 4/2020 Sharp ..... E02F 3/844
2020/0181876 A1 * 6/2020 Mahrenholz ..... E02F 3/962
2021/0231140 A1 * 7/2021 Ziemens ..... E02F 9/2235

FOREIGN PATENT DOCUMENTS

EP 0480036 A1 4/1992
EP 1106741 A1 6/2001
EP 2584102 A2 4/2013

* cited by examiner

ATTACHMENT-CONFIGURABLE SYSTEM FOR A WORK MACHINE

CROSS-REFERENCE TO RELATED APPLICATIONS

N/A

FIELD OF THE DISCLOSURE

The present disclosure relates to an attachment configurable system for a work machine.

BACKGROUND

Work machines, including crawler dozers, loaders, excavators, utility vehicles, tractors, and road pavers, to name a few, are generally vehicles comprising a boom that can be manipulated to perform a variety of functions. One of the challenges in the use of work machines are the large number of different work machines with their respective functions, control systems, user input parameters, standardized attachments, and their respective dependencies. Another challenge is the fact that typically a plurality of different attachments catered towards different functionalities may be coupled with several work machines.

Various issues exist for this problem. Operators of skid steers, crawler dozers, loaders and track loaders, for example, perform a myriad of functions using different attachments, using hand and/or foot controls on the user input interface. Typically control features include forward and reverse travel, turning/steering, travel speed, boom actuation through actuation of one or more hydraulic cylinders, and attachment actuation through one more hydraulic cylinders. For example, using a user input interface, such as a joystick, a common joystick movement command configuration on a compact track loader comprises the "ISO pattern". A compact track loader may have the ability to couple to a variety of attachments wherein some attachments may be of standardized use on one work machine, and another attachment may be of standardized use on another work machine. When an attachment, such as a box blade, is coupled to a compact track loader, the user input interface maintains the movement command configuration of a compact track loader, thereby creating inefficiencies in use when coupling the attachment to the work machine. Generally, third party aftermarket components, such as a box blade, comprise of an external control member detachably coupled to the user input interface in an operator cab for control of the attachment, thereby creating extraneous and sloppy features. For example, controlling the function of the box blade becomes confusing and difficult because of the non-intuitive control means of the box blade, generally found on a different type of work machine, such as an AG tractor. Therein lies a need to facilitate quick adaptation of movement command configurations for various work machines based on the attachment type using pre-existing control members integrated with the machine, wherein the user input interface, such as the joystick, for the operator becomes simplified. The following disclosure addresses this issue.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure includes an attachment-configurable control system, method, and apparatus for a work machine.

The attachment-configurable control system may comprise a work machine. The work machine may comprise a frame and a ground-engaging mechanism, the ground-engaging mechanism configured to support the frame on a surface, a boom assembly coupled to the frame, the boom assembly having a pair of boom arms pivotally coupled to the frame and moveable relative to the frame by a pair of first hydraulic cylinders, and an attachment coupler coupled to a distal section of the boom arms. The attachment coupler may be moveable relative to the frame by a pair of second hydraulic cylinders. The work machine may further comprise a hydraulic system communicatively coupled to a controller. The hydraulic system may comprise a hydraulic pump coupled to one or more of the pair of first hydraulic cylinders, the second pair of hydraulic cylinders, and an auxiliary hydraulic cylinder. The auxiliary hydraulic cylinder may actuate an attachment. The hydraulic pump delivers fluid through a plurality of flow paths wherein the plurality of flow paths are coupled to one or more of the first hydraulic cylinder, the second hydraulic cylinder, and the auxiliary hydraulic cylinder. The work machine may further comprise an operator cab coupled to the frame. The operator cab may comprise a user input interface which may further comprise a joystick. The joystick may be configured to move in at least a first direction wherein the first direction is the fore-aft direction, and at least a second direction wherein the second direction is transverse to the fore-aft direction. The work machine may also comprise a controller communicatively coupled to the user input interface. The user input interface may enable an operator to command movement of the attachment coupled to the boom assembly using a first movement command configuration based on coupling of a first attachment to the boom assembly, and a second movement command configuration based on coupling of a second attachment to the boom assembly. The first movement command configuration may comprise moving a joystick in the first direction actuating the pair of first hydraulic cylinders in a raising or a lowering of the boom assembly and in the second direction actuating the pair of second hydraulic cylinders in pitching the first attachment upwards or downwards. The second movement command configuration may comprise moving joystick in the first direction actuating the auxiliary hydraulic cylinders in lifting or lowering the second attachment, and moving joystick in the second direction comprises actuating the auxiliary hydraulic cylinders in tilting the second attachment relative to the work machine in a radial direction about the forward portion of the boom assembly. The second movement command configuration may further comprise actuating the auxiliary hydraulic cylinders to angle the second attachment relative to the work machine in the direction of yaw.

The controller may transmit a boom lower signal to the hydraulic system configured to lower the boom assembly to the frame one or more of immediately before, immediately after, and when switching to the second movement command configuration from the first movement command configuration.

The controller may then transmit a soft boom lock signal to inactivate a portion of the hydraulic system related to movement of the boom arms in one or more of the raising and the lowering of the boom assembly.

The controller may also transmit a hard boom lock signal to an actuator coupled to a boom lock. The boom lock may be configured to move from an unlocked position where the boom assembly is moveable to a locked position where the boom assembly is locked to the frame in the lowered position.

The second movement command configuration may further comprise an infinity switch on the joystick to activate proportionality of flow to the auxiliary hydraulic cylinder enabling the operator to control one or more of the speed of tilting the attachment, and the speed of moving the attachment upward or downwards.

The system may further comprise an identification device emitting an identification signal, the identification device coupled to the attachment and communicatively coupled to the controller, wherein the controller configures to one of the first movement command configuration and the second movement command configuration based on the identification signal.

The user input interface may further comprises a switch, the switch enabling the operator to toggle between the first movement command configuration and the second movement command configuration.

The user input interface may further enable the operator to activate the grade control system based on coupling of the second attachment to the boom assembly.

The second attachment may be either a box blade, an auger, a trencher, or a forklift.

The present disclosure further comprises a method for configuring a controller for a work machine based on an attachment coupled to the work machine, wherein the work machine extends in a fore-aft direction. The method includes coupling one of a first attachment or a second attachment to the boom assembly, identifying the attachment coupled to the boom assembly by a controller of the work machine; and enabling, by the controller of the work machine, an operator to command movement of the attachment coupled to the boom assembly using a user input interface in a first movement command configuration based on identifying the first attachment coupled to the boom assembly, and a second movement command configuration based on identifying the second attachment coupled to the boom assembly.

Finally, the system may further comprise a startup movement command configuration at startup of the work machine wherein the movement command configuration is the one of most recent use and stored in memory.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

The embodiments disclosed in the above drawings and the following detailed description are not intended to be exhaustive or to limit the disclosure to these embodiments. Rather, there are several variations and modifications which may be made without departing from the scope of the present disclosure.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Figure 1:
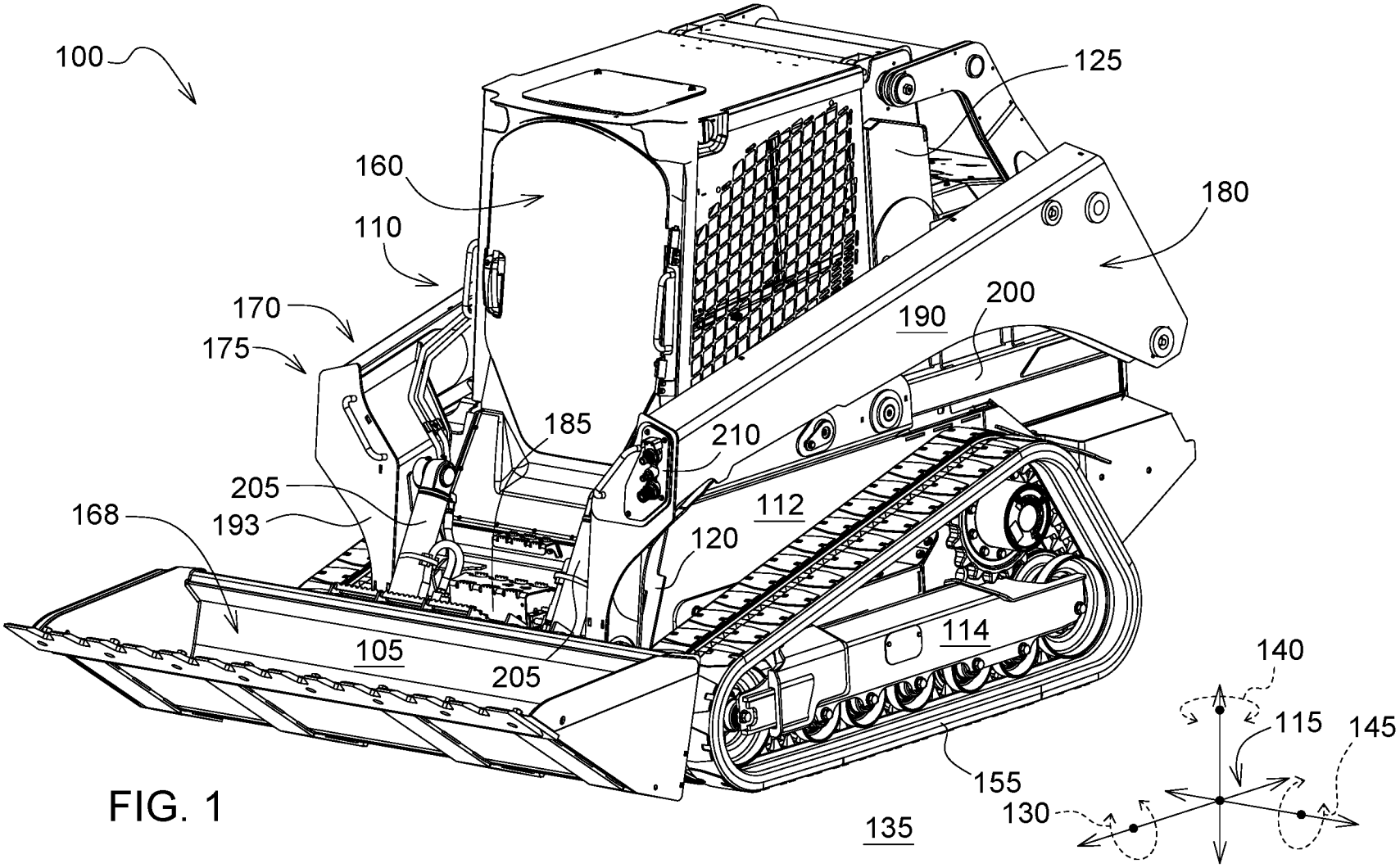
FIG. 1 is a perspective view of a compact track loader work machine according to one embodiment of the present disclosure.

FIG. 1 illustrates a work machine 100, extending in a fore-aft direction 115, depicted as a compact track loader with an attachment 105 operatively coupled to the work machine 100. It should be understood, however, that the work machine could be one of many types of work machines, including, and without limitation, a skid steer, a backhoe loader, a front loader, a bulldozer, and other construction vehicles. The work machine 100, as shown, has a frame 110, having a front-end section 120, or portion, and a rear-end section 125, or portion. The work machine includes a ground-engaging mechanism 155 that supports the frame 110 and an operator cab 160 supported on the frame 110, the ground-engaging mechanism 155 configured to support the frame 110 on a surface 135.

The engine 165 (shown in FIG. 2) is coupled to the frame 110 and is operable to move the work machine 100. The illustrated work machine includes tracks, but other embodiments can include one or more wheels that engage the surface 135. Work machine 100 may be operated to engage the surface 135 and cut and move material to achieve simple or complex features on the surface. As used herein, directions with regard to work machine 100 may be referred to from the perspective of an operator seated within the operator cab 160; the left of work machine 100 is to the left of such an operator, the right of work machine is to the right of such an operator, the front or fore of work machine 100 is the direction such an operator faces, the rear or aft of work machine is behind such an operator, the top of work machine is above such an operator, and the bottom of work machine below such an operator. The direction an operator faces on a compact track loader is towards the attachment 105. In order to turn, the ground-engaging mechanism 155 on the left side of the work machine 100 may be operated at a different speed, or in a different direction, from the ground-engaging mechanism 155 on the right side of the work machine 100. In a conventional compact track loader, the operator can manipulate controls from inside an operator cab 160 to drive the tracks on the right or left side of the work machine 100. The movement for work machine 100 may be referred to as roll 130 or the roll direction, pitch 145 or the pitch direction, and yaw 140 or the yaw direction (also shown in FIG. 4A).

The work machine 100 comprises a boom assembly 170 coupled to the frame 110. An attachment 105, or work tool, may be pivotally coupled at a forward portion 175 of the boom assembly 170, while a rear portion 180 of the boom assembly 170 is pivotally coupled to the frame 110. The frame 110 comprises a mainframe 112 and a track frame 114 (in other work machines the track frame may alternatively be referred to as a frame for a ground-engaging mechanism). The attachment 105 is illustrated as a bucket, but may be any number of work tools such as a blade, a fork, an auger, a drill, or a hammer, just to name a few possibilities. The attachment 105 may be coupled to the boom assembly 170 through an attachment coupler 185, such as Deere and Company's Quik-Tatch, which is an industry standard configuration and a coupler universally applicable to many Deere attachments and several after-market attachments. The attachment coupler 185 may be coupled to a distal section 193 of the boom arms 190, or more specifically a portion of the boom arms in the forward portion 175 of the boom assembly 170.

The boom assembly 170 comprises a first pair of boom arms 190 pivotally coupled to the frame 110 (one each on a left side and a right side of the operator cab 160) and moveable relative to the frame 110 by a pair of first hydraulic cylinders 200, wherein the pair of first hydraulic cylinders 200 may also conventionally be referred to as a pair of lift cylinders (one coupled to each boom arm) for a compact track loader. The attachment coupler 185 may be coupled to a distal section 193, or portion, of the pair of boom arms 190, being moveable relative to the frame 110 by a pair of second hydraulic cylinders 205, conventionally referred to as tilt cylinders for a compact track loader. The frame 110 of the work machine 100 further comprises a hydraulic coupler 210 on the front-end portion 120 of the work machine 100 to couple one or more auxiliary hydraulic cylinders 215 (shown in FIG. 2) to drive movement of or actuate auxiliary functions of an attachment 105. The attachment coupler 185 enables the mechanical coupling of the attachment to the frame 110. The hydraulic coupler 210, contrary to the attachment coupler 185, enables the hydraulic coupling of an auxiliary hydraulic cylinder(s) 215 on the attachment 105 to the hydraulic system 220 (shown in FIG. 2) of the work machine 100. Please note that not all attachments will have one or more auxiliary hydraulic cylinders and therefore may not use the hydraulic coupler 210. In the configuration disclosed in FIG. 1, wherein a bucket 168 is coupled to a compact track loader, the bucket 168 does not use the hydraulic coupler 210 or have auxiliary hydraulic cylinders 215. Auxiliary hydraulic cylinders 215 may be found on supplemental attachments, and located on the attachment 105 itself which may comprise its own sub-controller 242 (shown in the dotted box in FIG. 2) in communication with the controller 240 of the work machine. Alternatively, for example, the hydraulic coupler 210 may open or close a grapple type attachment, or spin a roller brush type attachment. In the embodiments described in detail below, the hydraulic coupler 210 is used in conjunction with reconfiguring a movement command configuration of the user input interface 245 (shown in FIG. 3A) from the operator cab 160 as it relates to movement of the attachment 105.

Each of the pair of first hydraulic cylinders 200, the pair of second hydraulic cylinders 205, and the auxiliary cylinders 215 (if applicable when found on the attachment 105) are double acting hydraulic cylinders. One end of each cylinder may be referred to as a head end, and the end of each cylinder opposite the head end may be referred to as a rod end. Each of the head end and the rod end may be fixedly coupled to another component, such as a pin-bushing or pin-bearing coupling, to name but two examples of pivotal connections. As a double acting hydraulic cylinder, each may exert a force in the extending or retracting direction. Directing pressurized hydraulic fluid 235 (shown in FIG. 2) into a head chamber of the cylinders will tend to exert a force in the extending direction, while directing pressurized hydraulic fluid into a rod chamber of the cylinders will tend to exert a force in the retracting direction. The head chamber and the rod chamber may both be located within a barrel of the hydraulic cylinder, and may both be part of a larger cavity which is separated by a moveable piston connected to a rod of the hydraulic cylinder. The volumes of each of the head chamber and the rod chamber change with movement of the piston, while movement of the piston results in extension or retraction of the hydraulic cylinder. The attachment-configurable control system 201 comprising these hydraulic cylinders will be described in further detail with regards to FIG. 2.

Figure 2:
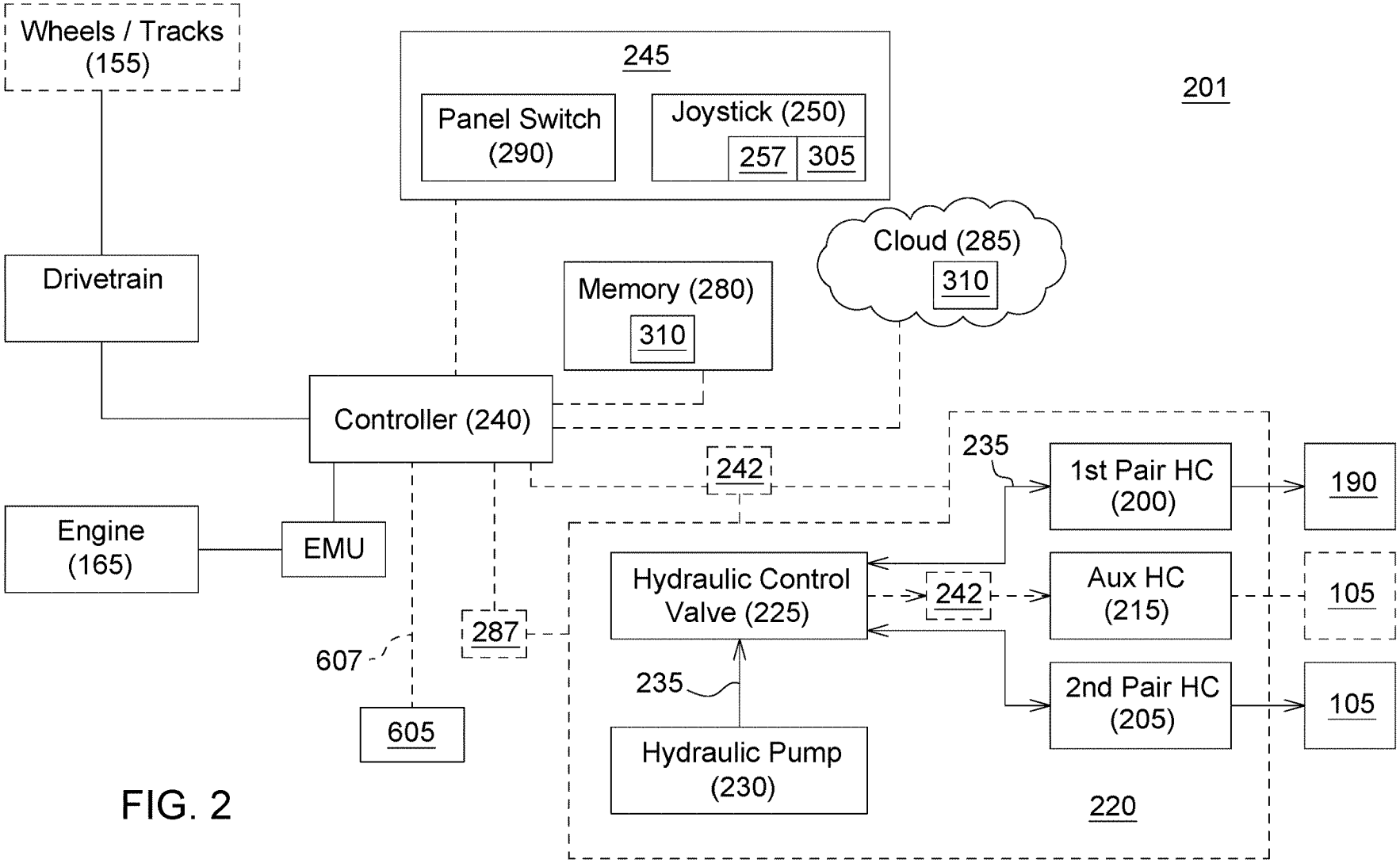
FIG. 2 is a schematic of the hydraulic system and other parts of the compact track loader of FIG. 1, according to one embodiment of the present disclosure.

FIG. 2 is a schematic of a portion of an attachment-configurable control system 201 for controlling the hydraulic cylinders (200, 205, 215) as it relates to the components of the work machine 100 in the embodiment disclosed herein, the system including hydraulic and electrical components. Each of the pair of first hydraulic cylinders 200, pair of second hydraulic cylinders 205, and the auxiliary hydraulic cylinder(s) 215 is coupled to hydraulic control valve 225, which may be positioned in a portion of the work machine 100. The auxiliary hydraulic cylinders may receive command signals from a sub-controller 242 located on an attachment 105. Hydraulic control valve 225 may also be referred to as a valve assembly or manifold. Hydraulic control valve 225 receives pressurized hydraulic fluid 235 from hydraulic pump 230, which generally may be coupled to the engine 165 or alternative power source, and directs such hydraulic fluid 235 to the pair of first hydraulic cylinders 200, the pair of second hydraulic cylinders 205, the auxiliary hydraulic cylinder(s) 215, and other hydraulic circuits or functions of the work machine (e.g. the hydrostatic drive motors for the left and right-side tracks). Hydraulic control valve 225 may meter such fluid out, or control the flow rate of hydraulic fluid 235 to each hydraulic circuit to which it is connected. Alternatively, hydraulic control valve 225 may not meter such fluid out but may instead only selectively provide flow to these functions while metering is performed by another component (e.g. a variable displacement hydraulic pump). Hydraulic control valve 225 may meter such fluid out through a plurality of flow paths or spools, whose positions control the flow of hydraulic fluid, and other hydraulic logic. The spools may be actuated by solenoids, pilots (e.g. pressurized hydraulic fluid acting on the spool), the pressure upstream or downstream of the spool, or some combination of these or other uses. The controller 240 of the work machine 100 actuates these solenoids by sending a specific current to each (e.g. 600 mA). In this way, the controller 240 may actuate an attachment 105 by issuing electrical command signals to direct hydraulic fluid 235 flow from the hydraulic pump 230 to the pair of first hydraulic cylinders 200, the pair of second hydraulic cylinders 205, and the auxiliary cylinder(s) 215.

Controller 240, which may also be referred to as a vehicle control unit (VCU), is in communication with a number of components on the work machine, including the hydraulic system 220, electrical components such as the user input interface 245 from within the operator cab 160 (shown in FIG. 1), and other components. Controller 240 is electrically coupled to these other components by a wiring harness such that messages, commands, and electrical power may be transmitted between controller 240 and the remainder of the work machine 100, or possibly even wirelessly. Controller 240 may be coupled to other controllers, such as the engine control unit (ECU), through a controller area network (CAN), or such as a sub-controller 242 of an attachment 105 wherein the sub-controller 242 interprets command signals from the controller 240 to control movement of the auxiliary hydraulic cylinders 215 located on an attachment 105. Controller may then send and receive messages over the CAN to communicate with other components of the CAN. The controller 240 may send command signals to actuate the attachment 105 by sending a command signal to actuate an input from the user input interface 245 from the operator cab 160. For example, an operator may use a joystick 250 to issue command to actuate an attachment 105, and the joystick 250 may generate hydraulic pressure signals communicated to hydraulic control valve 225 to cause actuation of the attachment 105. In such a configuration, controller 240 may be in communication with electrical devices (solenoids, motors) which may be actuated by a joystick 250 in operator cab 160. Other alternative inputs on a user input interface 245 with electric, or hydraulic pressure signals may include switches, buttons, roller tabs, sliding tabs, infinity switches, touchscreens, foot pedals, virtual operative signaling, to name a few.

The hydraulic system 220, communicatively coupled to the controller 240, is configured to operate the work machine 100 and operate the attachment 105 coupled to the work machine 100, including, without limitation, the attachment's lift mechanism, tilt mechanism, roll mechanism, pitch mechanism and auxiliary mechanisms, for example. This may also include moving the work machine in forward and reverse directions, moving the work machine left and right, and controlling the speed of the work machine's travel. Summarily, the hydraulic pump 230 may be coupled to one or more of the pair of first hydraulic cylinders 200, the pair of second hydraulic cylinders 205, and auxiliary hydraulic cylinder(s) 215, wherein one or more of the pair of first hydraulic cylinders 200, the pair of second hydraulic cylinders 205, and the auxiliary hydraulic cylinders 215, may actuate the attachment 105 depending on the configuration of the attachment. The hydraulic pump 230 may deliver fluid through the plurality of flow paths, the plurality of flow paths coupled to one or more of the pair of first hydraulic cylinders 200, the pair of second hydraulic cylinders 205, and the auxiliary hydraulic cylinder(s) 215.

Figure 3A:
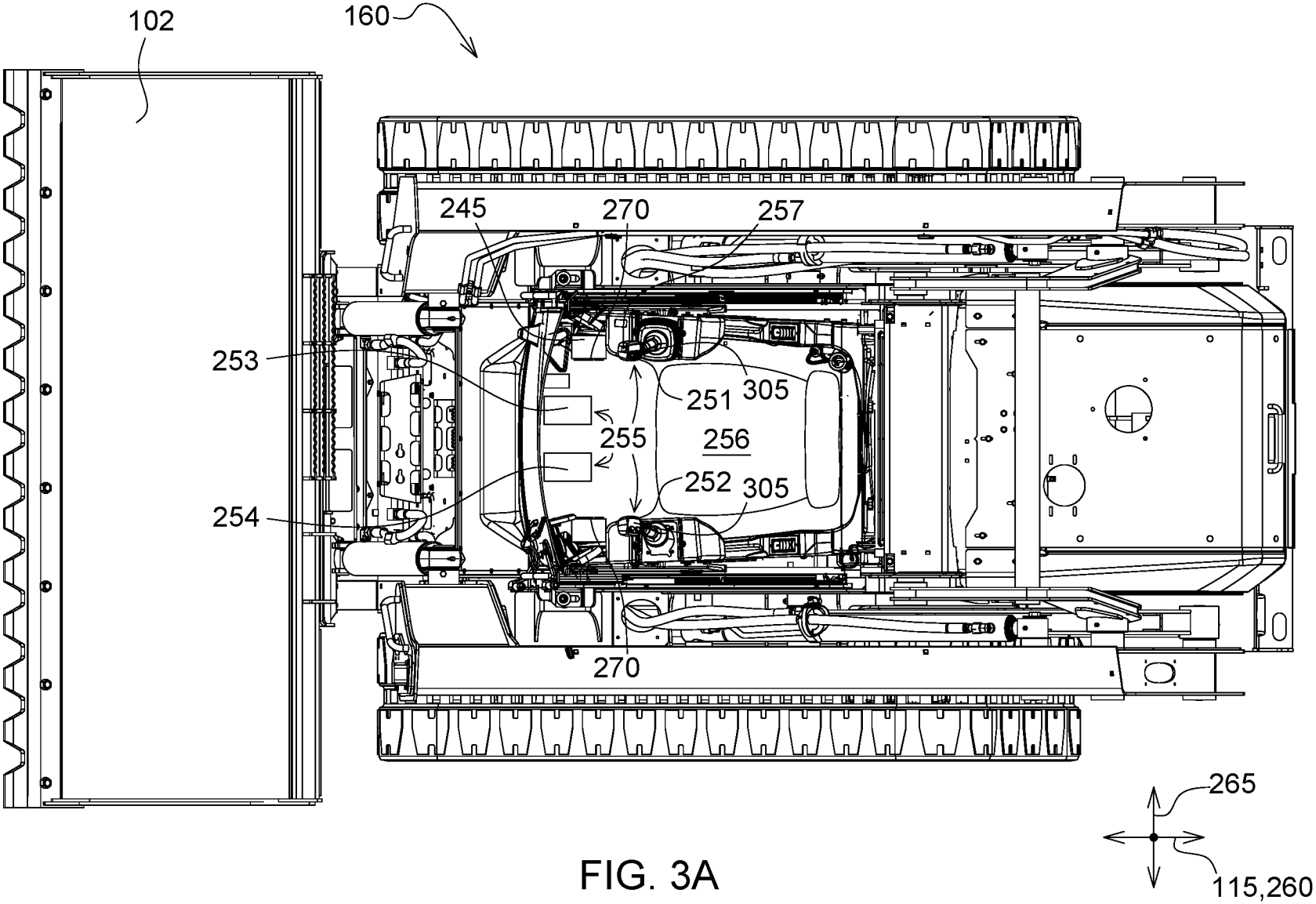
FIG. 3A is a top view of the operator cab of the compact track loader of FIG. 1 according to one embodiment of the present disclosure.
Figure 3B:
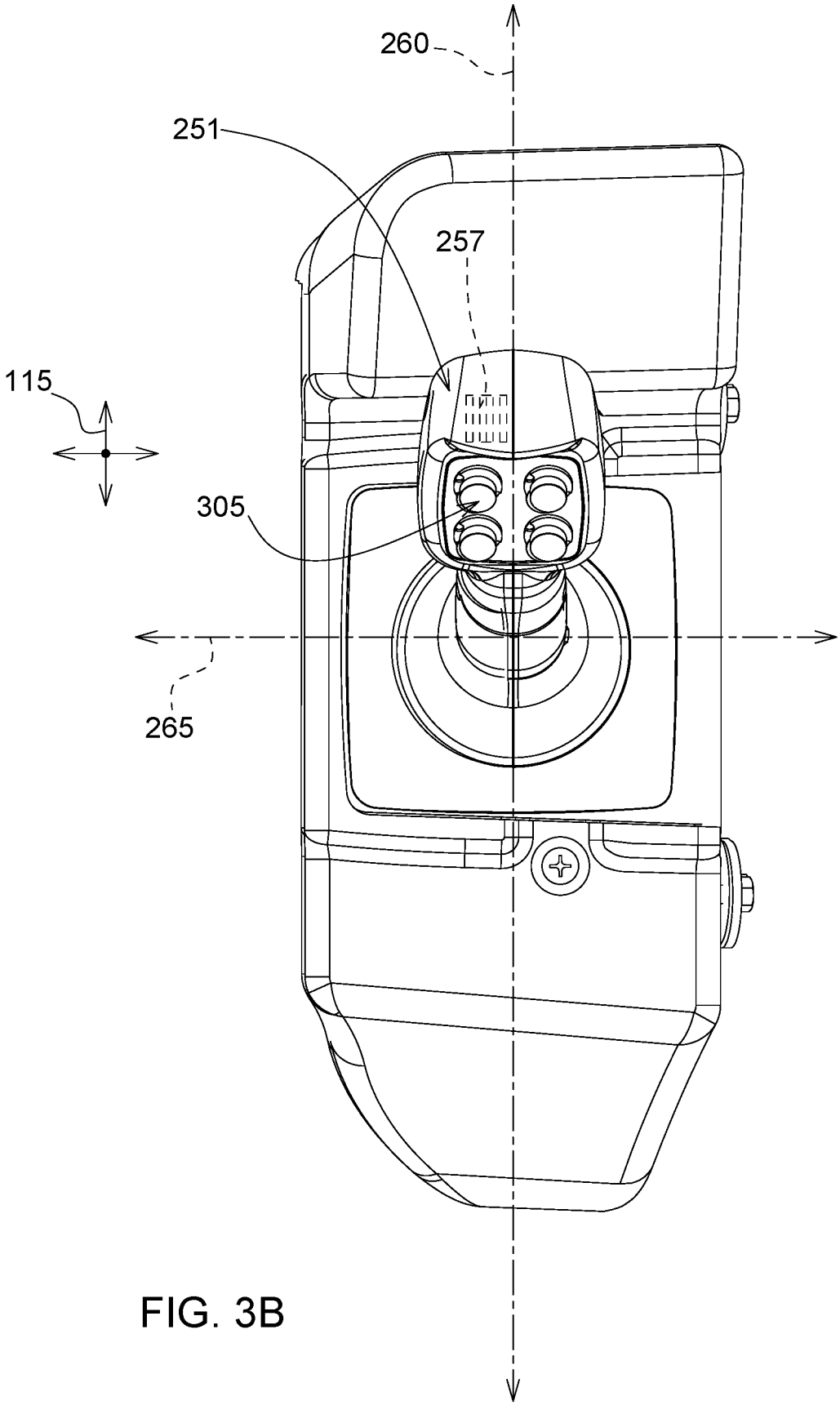
FIG. 3B is a detailed view of a control member, a joystick, of the user input interface according to one embodiment of the present disclosure.

Now turning to FIGS. 3A and 3B with continued reference to FIGS. 1 and 2, a portion of the user input interface 245 found in the operator cab 160 is shown. The operator cab 160 has a bottom portion and a left-side portion and a right-side portion. The operator cab 160 includes a seat 256 coupled to the bottom portion. The operator cab 160 further includes at least one user input interface 245 comprising a control member 255. The control member 255 shown may include a right joystick 251, a left joystick 252, a right foot pedal 253, and a left foot pedal 254. However, it should be understood, that any number of control members may be used. The right and left joysticks (251, 252) are located adjacent to the seat 256 and are attached to the first-side portion and the second-side portion of the operator cab 160, respectively. The right 253 and left 254 foot pedals are attached to the bottom portion of operator cab 160. The right and left joysticks may be configured to move in at least a first direction 260 wherein the first direction 260 is a fore-aft direction 115 or a substantially fore-aft direction, and at least a second direction 265 wherein the second direction is transverse to the fore-aft direction 115, or substantially transverse to the fore-aft direction 115. The second direction 265 may alternatively be described as substantially perpendicular to the first direction 260. The user input interface 245 may further comprise switches (activators) thereon, wherein the switch may be located on a panel 270 directly above the operator, a display screen as a touchscreen graphic, or a joystick, to name a few. Embodiments are envisioned where switches are also located at other locations in the operator cab 160. In the embodiment shown in FIG. 3B, right joystick 251 may have various switches 305 (activators) mounted thereon. The switches 305 can be designated for different things depending on various factors including, but not limited to, the specific attachment 105 coupled to the work machine 100. In the present disclosure, the functionality of the joystick 251 is changeable via operation of toggle switch 305. The toggle switch 305 is illustratively a "toggle" type switch (providing for continuous "on" or "off" or potentially momentary "on" or "off") between a first movement command configuration 275 (i.e. the default movement command configuration, or first movement command configuration of the work machine as described in further detail below and shown in FIGS. 4A-4B) and an alternate movement command configuration 310. The alternate movement command configuration 310 may be the second movement command configuration 295 (as described in greater detail below and shown in FIG. 5B), or a third movement command configuration, or a fourth movement command configuration, etc., wherein the alternate movement command configurations are alternatives based on the type of attachment 105 coupled to the work machine 100. Please note that with respect to the disclosure, the terms second movement command configuration 295 and alternate movement command configuration 310 may be used interchangeably throughout. Although placement of the toggle switch 305 on the joystick 251 may be preferable because of ease of momentarily toggling between modes and/or configurations, the toggle switch may be placed in alternate areas of the user input interface 245. Placement of the toggle switch 305 on the joystick 251 advantageously improves safety by eliminating the need for the operator to look away when switching between movement command configurations. Please note that although the embodiment disclosed herein addresses reconfiguring the movement command configuration on the right joystick 251, the reconfiguring may also occur on an alternative control member such as the left joystick 252, and therefore should not be limited to the embodiment described herein. The right joystick 251 may further comprise an infinity switch 257 to adjust the proportionality of fluid flow to the hydraulic cylinders (200, 205, or 215) in relation to joystick movement to control one or more of the speed of tilting the attachment 105, and the speed of moving the attachment upwards or downwards when in the second movement configuration 295.

Figures 4A, 4B:
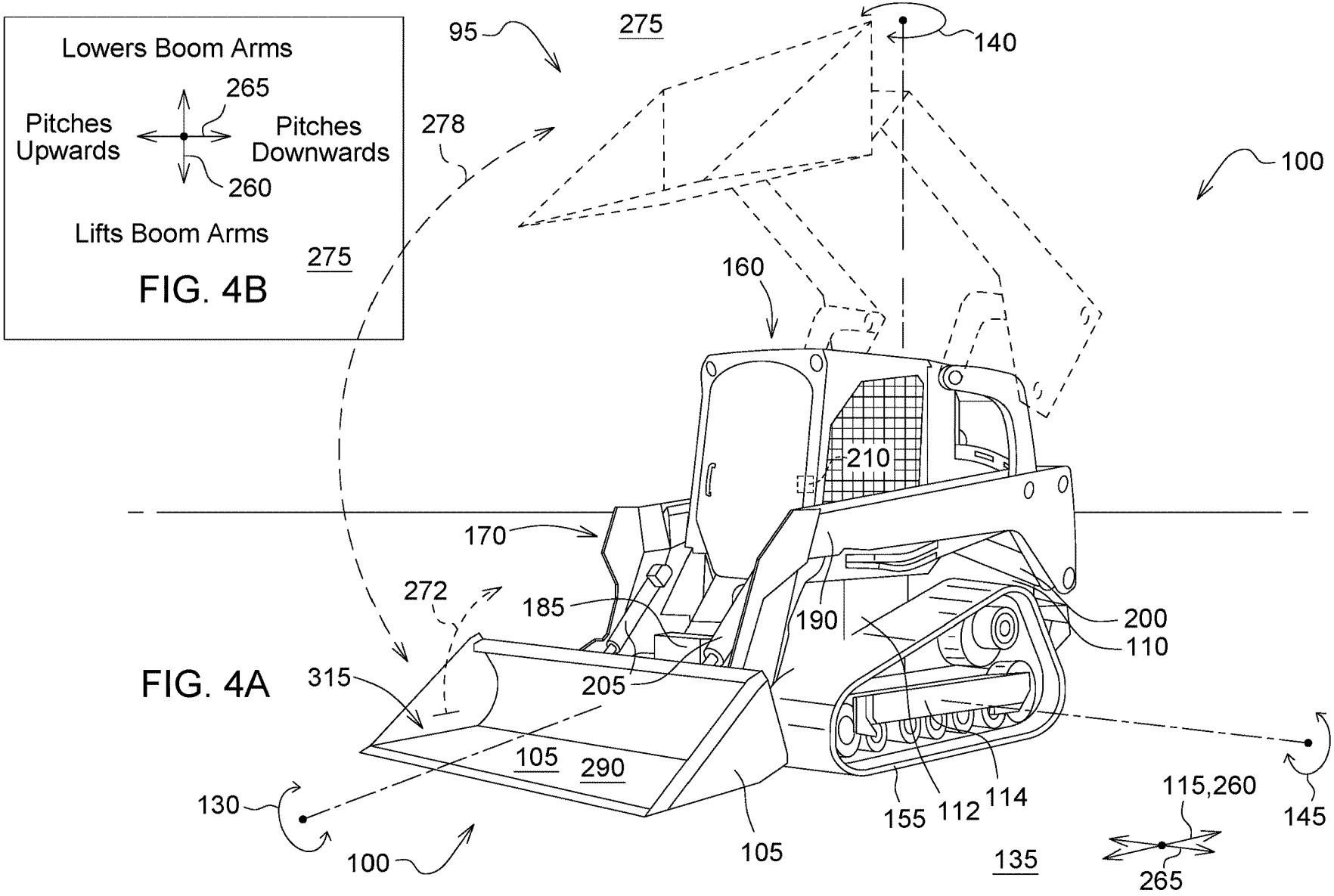
FIG. 4A is a perspective view of a compact track loader according to another embodiment of the present disclosure having a bucket.
FIG. 4B is a schematic of joystick movement according to a first movement command configuration.

Now turning to FIGS. 4A-4B with continued reference to FIG. 2, 3A-3B, general joystick operation of compact track loaders is shown. The schematic shown in FIG. 4B is a top view drawing representing joystick movement as identified. In one embodiment, joystick operation is conducted via the ISO standard.

According to the ISO standard, the left-hand joystick controls operation of the ground engaging mechanism 155 to translate and turn the machine (i.e. the compact track loader) over the surface 135 (e.g. to move in the fore-aft direction 115 or turn in a yaw direction 140). According to the ISO standard, the right-hand joystick 251 controls operation of the pair of boom arms 190 and the attachment 105 in a first movement command configuration 275 (shown in FIG. 4B), or may also be referred to as a default command configuration, as described in the following. Moving joystick in the first direction 260 (i.e. the fore-aft direction 115 or substantially fore-aft direction), that is pressing forward on the right-hand joystick 251 lowers the pair of boom arms 190 and pulling back lifts the boom arms 190 (as indicated by the arrows and lift dotted trajectory 278 in FIG. 4A). Moving joystick in the second direction 265, that is tilting joystick right pitches attachment 105 downward and tilting joystick left pitches attachment upward (as indicated by the arrows and tilt dotted trajectory 272 in FIG. 4A).

The control members 255 (e.g. joystick 250) are communicatively coupled to the controller 240 such that the control members 255 are capable of sending a command signal to the controller 240 indicative of the position of the control members 255 correlating to a degree and direction of movement for a respective hydraulic cylinder (200, 205, or 215). The controller 240 may comprise of a plurality of predetermined movement command configurations and is capable of sending signals to the hydraulic system 220 to control the operations of the work machine 100, boom assembly 170 of the work machine 100, and the attachment 105. The movement command configurations may be defined as maps that coordinate the position of the control members 255 to the command signals being sent to the hydraulic system 220, wherein the hydraulic system redirects the flow path of the fluid 235 and respective pressures through each respective flow path, in addition to modifying other work machine settings, described further below. The controller 240 may be programmed with a plurality of alternate movement command configurations 310, such as the second movement command configuration 295, discussed below, through a direct link from memory 280 or storage medium (shown in FIG. 2), or remotely from a data cloud 285 (also shown in FIG. 2). The controller 240, operably coupled to the user input interface 245, enables an operator to command movement of the attachment 105 coupled to the boom assembly 170 in a first movement command configuration 275 based on coupling of a first attachment 290 (described as bucket 315 in this embodiment) to the boom assembly 170, and a second movement command configuration 295 based on coupling of a second attachment 300 (described as box blade 320 in this embodiment) to the boom assembly 170, the second attachment 300 being different from the first attachment 290. In the embodiment described herein, the first movement command configuration 275 for the compact track loader is the default movement command configuration (or first movement command configuration 275), generally for use with an attachment 105 such as a bucket 315.

Figures 5A, 5B:
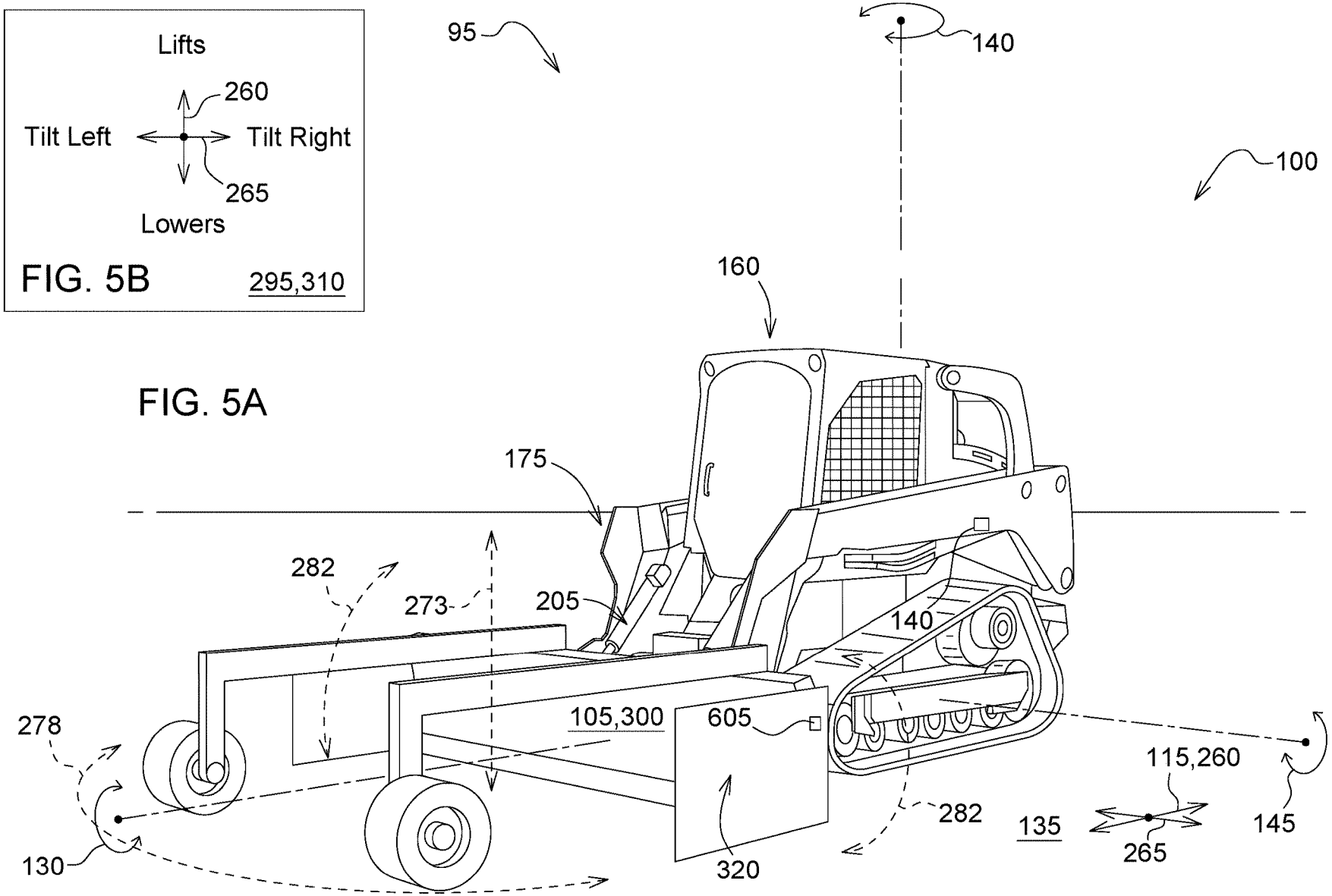
FIG. 5A is a perspective view of a compact track loader according to an embodiment of the present disclosure having a box blade.
FIG. 5B is a schematic of a joystick movement according to a second movement command configuration wherein the second attachment is a box blade.

With continued reference to the present embodiments, FIGS. 5A and 5B show the second movement command configuration 295. The second movement command configuration 295, as described in the present embodiment, is generally intended for use with a second attachment 300, wherein the second movement command configuration 295 is for a box blade 320. The second movement command configuration 295 comprises moving joystick 251, shown as schematic 5B, in the first direction 260 correlating to actuating the auxiliary hydraulic cylinders 215 (not shown) in vertically lifting or lowering the attachment 105 (shown as dotted trajectory 273).

The second movement command configuration 295, further comprises moving the joystick 251 in the second direction 265 tilts the box blade 320 relative to the work machine 100, which may also be referred to as moving box blade in the direction of roll 130. That is, actuating the auxiliary hydraulic cylinder(s) 215 to actuate the attachment 105 tilts box blade in a radial motion about the forward portion 175 of the boom assembly 170 (shown by dotted lines 282). An actuator, or type of infinity switch 257 exemplified as a thumbwheel (shown in FIG. 3B), and located on joystick 251, regulates the proportionality of fluid flow to the auxiliary hydraulic cylinders 215 enabling the operator to control one or more of the speed of tilting the attachment, and the speed of moving the attachment upwards or downwards, thereby advantageously creating a fine tune control for fine grading. The adaptation of the compact track loader in the present embodiment to utilize a user input interface already integrated into the operator cab, when using a box blade 320 in conjunction with the second movement command configuration 295 of the joystick 250, provides several other advantages because the compact track loader becomes more streamlined. These advantages include a reduction in the number of work machines on a worksite because of increased versatility (box blades may generally be used with AG tractors or compact track loaders with external control members); reduction in the number of control members 255 on a work machine because additive detachable control members are no longer required to utilize a third party attachment with the work machine, reduction in work machine transport costs to a worksite because of the reduced need in the number of work machines and work machine size (i.e. an AG tractor is not required), an improved confined space grading because the compact track loader may utilize the automated control features such as a grade control system 287 (discussed below) already integrated into the controller 240 of a work machine; reduction in the required spend by an equipment lessee or equipment company owner; reduction in labor training because the movement command configurations adapt based on the function of the attachment (e.g. joystick controls may be more intuitive using the above-mentioned second movement command configuration 295); optimized machine asset utilization; and increased work versatility because a worksite manager may take on more renovation type work in confined spaces where efficiently shaping the surface in narrow areas, without affecting surrounding buildings, now becomes possible because of the smaller powerful work machine with box blade function (an ability an AG tractor would find difficult to do). Furthermore, Deere's compact track loader utilizes a Smart Grade system wherein the controller may automatically control the elevation of the attachment 105 according to the grade command or grade set by the operator. Use of the box blade 320 on a compact track loader advantageously allows for use of this feature, furthering easing operator control of the work machine 100. The user input interface 245 may enable the operator to activate the grade control system 287 (shown in FIG. 2) based on coupling of the second attachment 300 to the boom assembly 170. The controller 240 may determine whether to enable the grade control system 287 based on the identification of the second attachment 300. In one exemplary embodiment, the controller 240 may suggest use of the grade control system 287 when the second attachment 300 (box blade 320 or alternatively a blade) is coupled to the work machine 100. The box blade 320 is generally used for fine grade grading wherein the volume of the "box" is known thereby allowing the box blade 320 to deposit ground material at a known volume. Using the grade control system 287 in conjunction with the box blade 320 optimizes fine grading applications.

One the other hand, a bucket 315 is commonly used to move volumes of material from one area to another, or load material into another work machine such as an articulated dump truck. The box blade 320 is an attachment which may engage the ground or material to move or shape it. Box blade 320 may be used to move material from one location to another and to create features on the ground, including flat area, grades, hills, roads, or more complexly shaped features. The box blade 320 may be hydraulically actuated to lift or lower, roll left or roll right 282 (which may be referred to tilt left and tilt right), and angle left or angle right 278 in the direction of yaw. Embodiment may also utilize a box blade 320 with fewer hydraulically controlled degrees of freedom, such as a 4-way box blade, that may not be angled or actuated in the direction of yaw 140.

Immediately before or after, or when the controller 240 switches from a first movement configuration 275 to a second movement command configuration 295, the controller 240 may transmit a boom lower signal (not shown) to the hydraulic system 220 configured to lower the boom assembly 170 to the frame 110, in anticipation of use of an attachment 105 in the form of the box blade 320.

In addition, in the present embodiment, the pair of first hydraulic cylinders 200 may move in a retracting direction and the boom assembly 170 is lowered towards the frame 110 until the boom assembly 170 rests on a portion of the frame 110 of the work machine 100 which may comprise of mounting pad(s), one each located on at least a left side and a right side of the work machine 100. The mounting pad(s) advantageously allows the reactive forces encountered by the second attachment 300 as it grades the surface to substantially or in a greater amount transmit through the frame 110 of the work machine 100 as opposed to the attachment coupler 185. The frame 110 of the work machine 100 spans a larger cross-sectional area in addition to having a shock absorbing system (e.g. springs, dampeners throughout) to absorb the reactive forces. During a grading operation, the compact track loader is forwarded so that box blade 320 is driven into earth, stones, gravel or similar material. In one exemplary embodiment, the box blade pitch angle will vary based on the conditions of the surface 135 (e.g. moisture, hardness, stickiness). Please note this angle may be modified mechanically prior to using the work machine by a pitch link (not shown), or of a similar mechanism.

The controller 240 may further transmit a soft boom lock signal (not shown) to inactivate the portion of the hydraulic system 220 related to the pair of first hydraulic cylinders 200 related to movement of the pair of boom arms 190 in one or more of the lifting and the lowering of the boom arms 190 and related to the pair of second hydraulic cylinders 205 related to pitching the attachment upwards and downward. In the present embodiment, for example, flow to or from the flow path of the pair of first hydraulic cylinders 200 may be inactivated wherein the pair of the first hydraulic cylinders 200 are neither extended nor retracted, such that the boom assembly 170 may rests on the mounting pads (although not required). The pair of boom arms 190, in other words, would be hydraulically locked. Similarly, the pair of second hydraulic cylinders 205 would remain stationary where the hydraulic fluid 235 related to the portions of actuating the afore-mentioned hydraulic cylinders (200, 205) are neither pressurized nor de-pressurized.

Figure 6A:
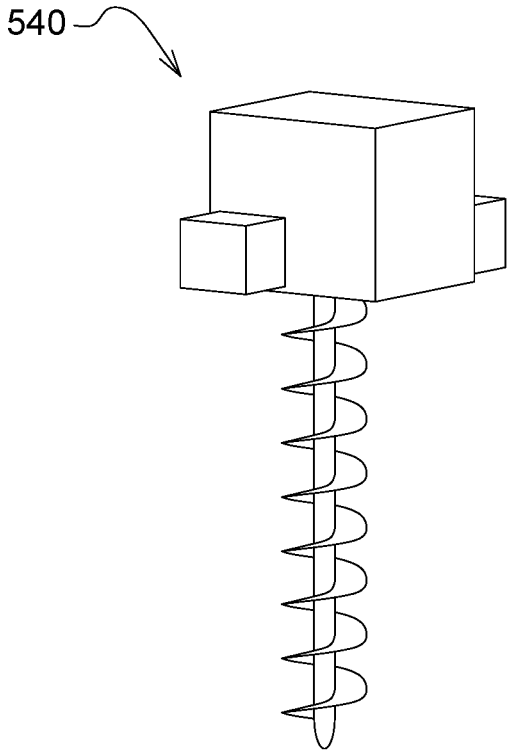
FIG. 6A is an alternative second attachment wherein the second attachment is an auger.
Figure 6B:
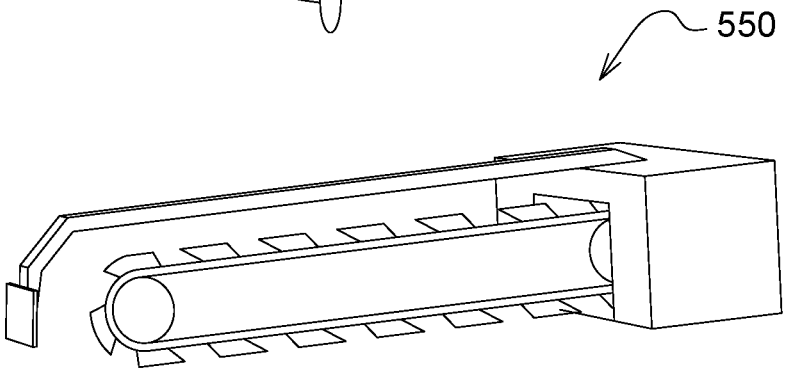
FIG. 6B is an alternative second attachment wherein the second attachment is a trencher.
Figure 6C:
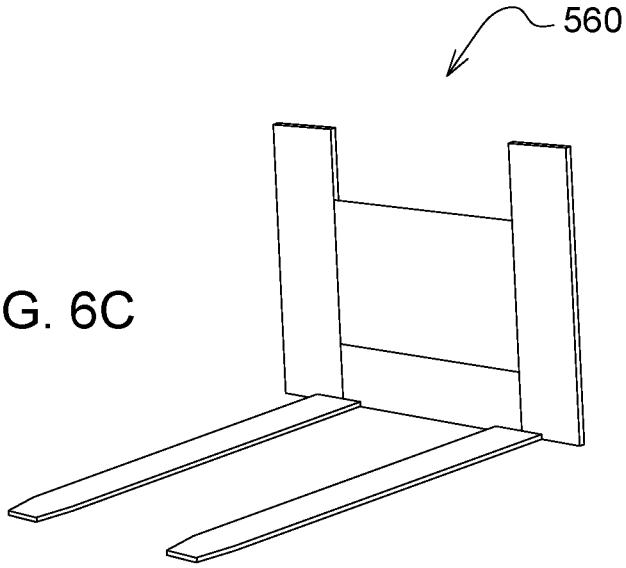
FIG. 6C is an alternative second attachment wherein the second attachment is a fork.

FIGS. 6A, 6B, and 6C show an alternative second attachment wherein the second attachment is one or more of an auger 540, a trencher 550, and a fork 560, respectively.

Figure 7:
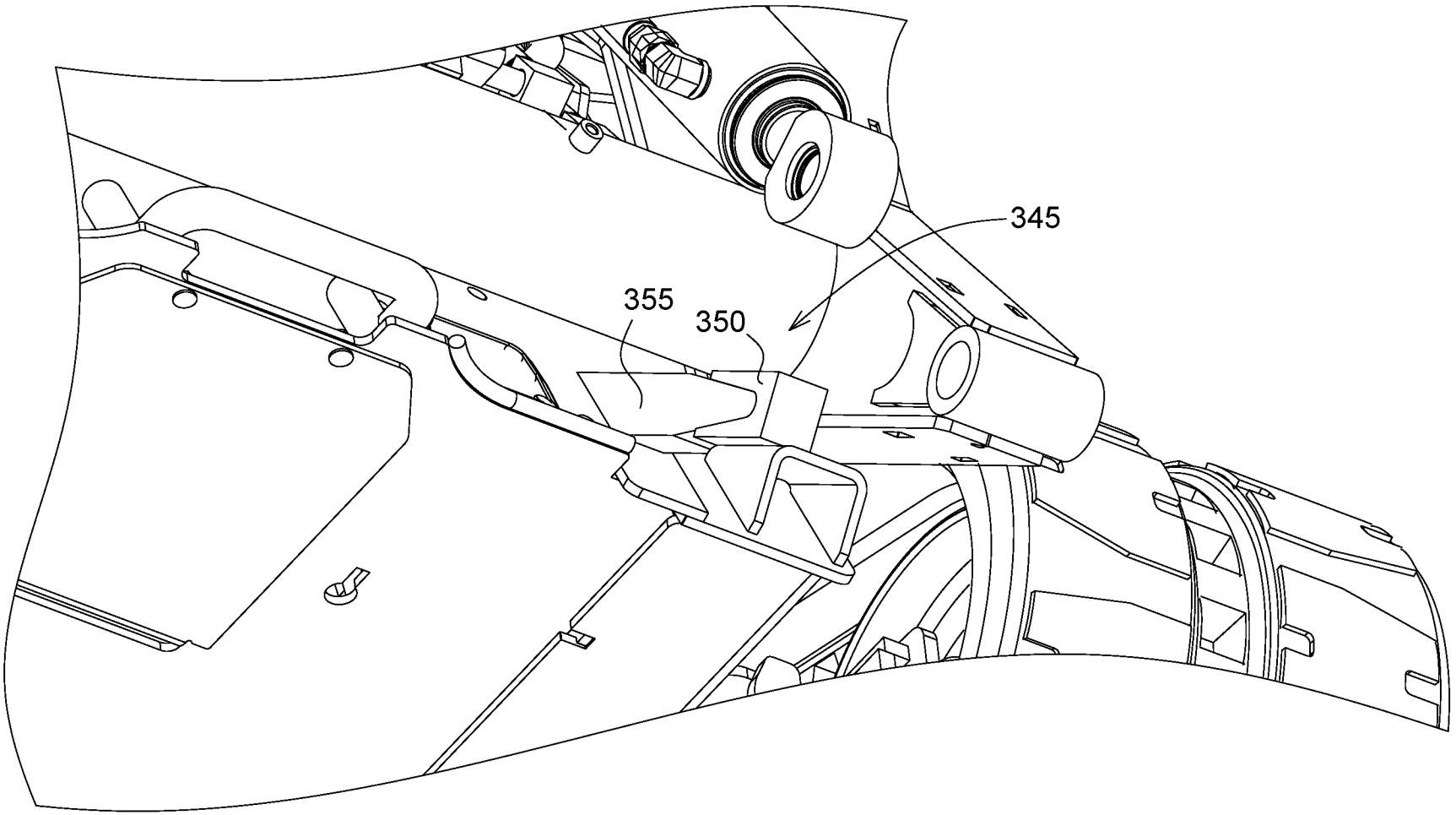
FIG. 7 is a detailed view of a mechanical locking mechanism of the compact track load of FIG. 1 according to one embodiment of the present disclosure.

Now referring to FIG. 7, the controller 240 may further transmit a hard boom lock signal (not shown) to an actuator coupled to a boom lock 345. The hard boom lock 345, alternatively referred to as a mechanical lock, may be coupled to at least one of the frame 110 and the boom assembly 170, being configured to move from an unlocked position where the boom assembly 170 is moveable and a locked position where the boom assembly 170 is mechanically locked to the frame 110 when in the lowered position. The hard boom lock 345 comprises a receiving device 350 coupled to at least one of the boom assembly 170 and the frame 110, wherein the receiving device 350 is configured to receive a movable shaft 355 coupled to at least one of the other of the boom assembly 170 and the frame 110.

Figure 8:
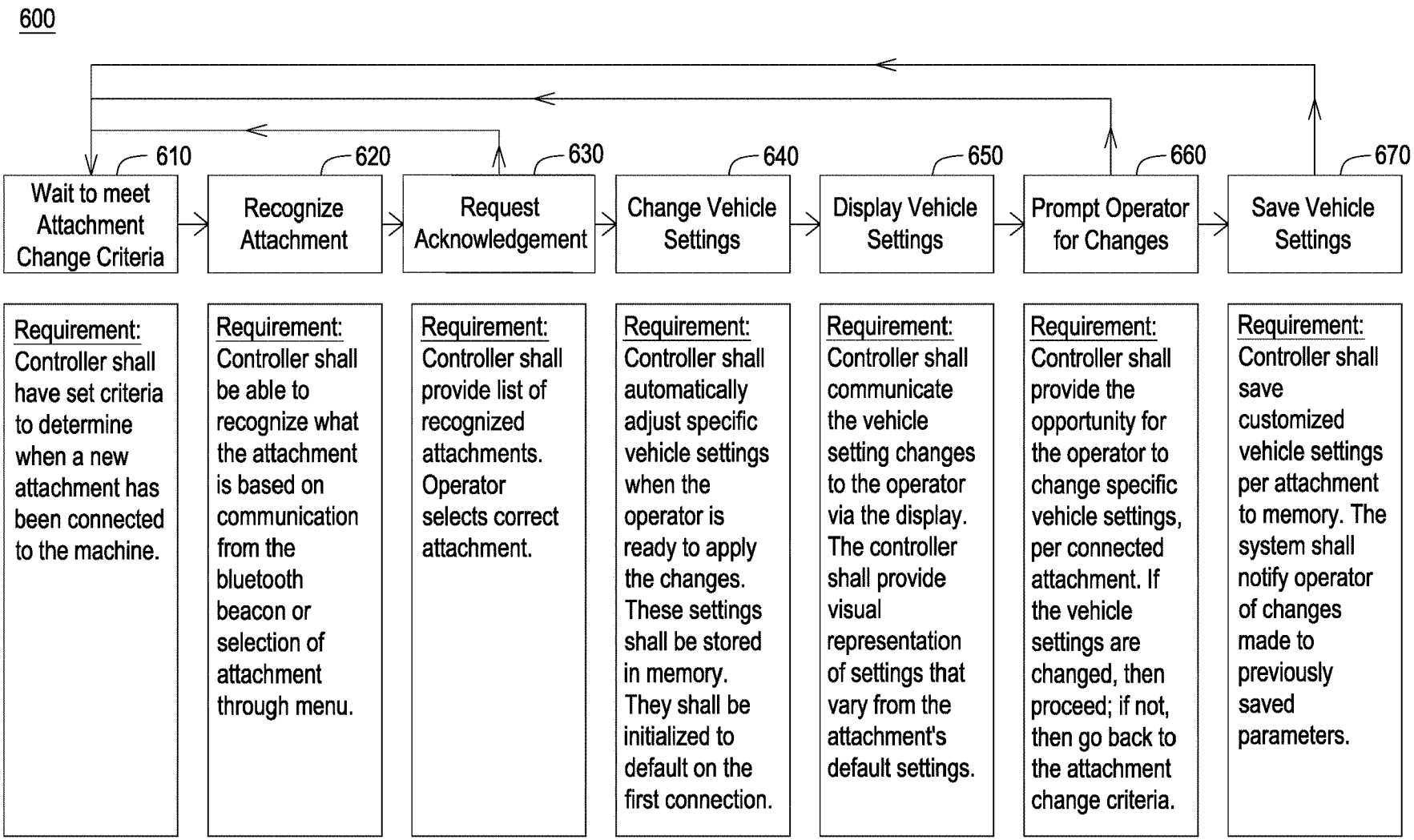
FIG. 8 is a flowchart detailing the method for configuring a control system for a work machine with the use of an identification device according to one embodiment of the present disclosure.

Referring to FIG. 8 and FIG. 1, with continued reference to FIGS. 2-6, a method 600 for configuring a control system based on the attachment 105, wherein the method comprises an identification device 605 communicatively coupled to the attachment 105, is shown. The identification device 605, preferably located somewhere on the attachment 605, may emit an identification signal 607 prior to, during, or after the attachment 105 couples to the work machine 100. In a first block 610 of the method, the controller 240 of the work machine 100 will wait or standby until attachment change criteria are met. The controller 240 shall have preprogrammed criteria to help the controller determine when a new attachment 105 has been coupled to the work machine 100. In one exemplary embodiment disclosed herein, the controller 240 may begin configuring automatically when either the attachment 105 is coupled to the work machine 100 via the attachment coupler 185, when the hydraulic cylinders (200, 205, or 215) of the attachment 105 are coupled to the work machine 100 via the hydraulic coupler 210, or both. Alternatively, the operator can determine when the attachment criteria are met wherein the work machine 100 is ready to initiate configurating by pushing an activator, or switch 305 (e.g. a "connect" button on the control panel) when the attachment 105 is mechanically coupled, and hydraulic coupled (if required) to the work machine. In another block 620, the method may further include the controller 240 recognize the attachment 105. The controller 240 shall be able to recognize the attachment based on communication from identification signal 607 (e.g. Bluetooth). Alternatively, the operator may select the attachment 105 through a pop-up menu on a display screen on the control panel aggregating all identification signals received, or a pre-populated list from memory.

Additionally, in block 630, the controller may request acknowledgment, as a confirmation of previous step 620. The operator will select or confirm the attachment 105 from the display screen on the user input interface 245.

In block 640, the method may further include the controller 240 automatically adjusting specific vehicle settings based on the type of attachment 105 coupled to the work machine 100. The machine settings may be stored in memory, and comprise default setting configurations based on the attachment type. The machine settings may include, and are not limited to, movement command configurations for the joystick, hydraulic flow, rim-pull, mode, idle speed, display, etc. For example, an attachment 105 identified as a high-flow attachment will turn high flow on. In another example, if an attachment is a slow-moving attachment, creep will be turned on. If the attachment is a box blade 320, box blade mode will be turned on. Furthermore, in step 650, the controller 240 may communicate vehicle settings to the operator via the display. The controller shall provide visual representation of the settings that may have been previously modified from the attachment's default settings from memory 280. In block 660, the controller 240 may prompt the operator for desired changes in the machine settings. In one embodiment, the control system shall provide the opportunity for the operator to change specific work machine settings based on the coupled attachment. That is the control system will provide limited customization of the machine settings based on the attachment to ensure safety, functionality, and efficacy of the work machine. Finally, in block 670, the controller 240 may then save the customized machine settings to memory. This customized setting may be the default setting a next time the attachment 105 is coupled to the work machine. The method outlined above, allows the attachment-configurable control system for a work machine using an identification device 605 coupled to the attachment 105, wherein the identification device 605 emits an identification signal 607 identifying the attachment type, to automatically switch to one of the first movement command configuration 275 and the second movement command configuration 295 based on the identification signal 607. Accordingly, the movement command configuration at startup of the work machine may be the movement command configuration most recently used.

Figure 9:
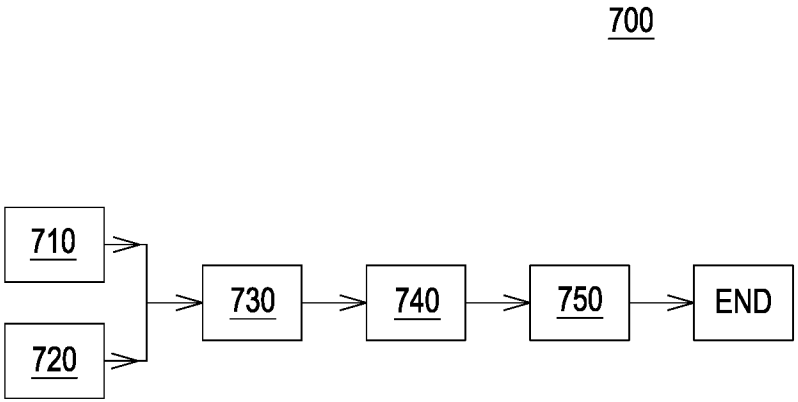
FIG. 9 is flowchart detailing the method for configuring a control system for a work machine based on the attachment coupled to the work machine according to one embodiment of the present disclosure.

Referring to FIG. 9, a method 700 for configuring a control system 240 for a work machine 100 based on an attachment 105 coupled to the work machine, for the embodiment in FIG. 1 is shown.

In block 710, the operator couples one of a first attachment 290 or a second attachment 300 to the work machine 100. As previously mentioned, the first attachment 290 may also be referred to as the default attachment the work machine 100 is customarily used with. The second attachment 300, may also be referred to as the alternate attachment (i.e. an attachment typically found another work machine, or an attachment generally sold as an accessory wherein use of a first movement command configuration 275 (or default) may not be intuitive to the operator with the alternate attachment).

In block 720, the controller 240 of the work machine 100 identifies the attachment 105 coupled to the work machine 100, or more specifically the boom assembly 170. The identification may occur through the operator manually picking the type of attachment from a drop-down menu shown on a screen of the user input interface 245 wherein the menu discloses local identification signals, or toggling a switch until it displays the appropriate attachment mode. Alternatively, the attachment 105 may be coupled to an identification device 605 that emits a wireless identification signal 607 to the controller 240 on the work machine 100. In another instance, a sub-controller 242 may be located on attachment 105 and be communicatively coupled to the controller 240 of the work machine 100 the moment the attachment is coupled with the hydraulic coupler 210, a pin connection, or some other physical means. Furthermore, although steps 710 and 720 are shown in the present order, the occurrence of one does not necessarily precede the other. Step 720 may also come before step 710.

In block 730, the controller transmits a boom lower signal to the hydraulic system 220, whereby the controller 340 may switch to the second movement command configuration 295 from the first command configuration 275 either immediately before, immediately after, or when the boom lower signal is sent to the hydraulic system. Once the lowering of the pair of boom arms 190 occurs, a soft boom lock signal is sent by the controller 240 to inactivate a portion of the hydraulic system related to movement of the boom arms in one or more of raising and lowering of the boom arms. The inactivation of the portion of the hydraulic system 220 is dependent on placement of the relative hydraulics and associated actuators, solenoids, etc. that result in inactivation of the pair of boom arms 190 once the boom arms are lowered. The same may be true in reverse, wherein the controller sends a soft boom unlock signal to activate a portion of the hydraulic system related to movement of the boom arms when switching from a second movement command configuration 295 to a first movement command configuration 275.

In block 740, the controller may transmit a hard boom lock signal to an actuator coupled to a boom lock where the boom lock 345 is configured to move from an unlocked position where the boom assembly 170 is moveable to a locked position where the boom assembly 170 is locked to the frame in the lowered position. In this configuration, for a box blade 320, neither the pair of first hydraulic cylinders 200 and the pair of second hydraulic cylinders 205 are actuated.

In block 750, the controller 240 enables the operator to command movement of the attachment 105 coupled to the boom assembly 190 using a user input interface 245 in a first movement command configuration 275 based on identifying the first attachment 290 coupled to the boom assembly 170, and a second movement command configuration 295 based on identifying the second attachment 300 coupled to the boom assembly 190. The user input interface 245 of the present embodiment is a right joystick 251 in the operator cab 160 of a compact track loader (or a skid steer) wherein the first attachment 290 is a bucket 315, and the second attachment 300 is a box blade 320.

Finally, upon turning off the work machine, a next time, the controller 240 initiates in a startup movement command configuration at the following startup of the work machine wherein the movement command configuration is the one most recently used and stored in memory, thereby allowing the operator to proceed from where they paused.

The terminology used herein is for the purpose of describing particular embodiments or implementations and is not intended to be limiting of the disclosure. As used herein, the singular forms "a", "an" and "the" are intended to include the plural forms as well, unless the context clearly indicates otherwise. It will be further understood that the any use of the terms "has," "have," "having," "include," "includes," "including," "comprise," "comprises," "comprising," or the like, in this specification, identifies the presence of stated features, integers, steps, operations, elements, and/or components, but does not preclude the presence or addition of one or more other features, integers, steps, operations, elements, components, and/or groups thereof.

The references "A" and "B" used with reference numerals herein are merely for clarification when describing multiple implementations of an apparatus.

One or more of the steps or operations in any of the methods, processes, or systems discussed herein may be omitted, repeated, or re-ordered and are within the scope of the present disclosure.

While the above describes example embodiments of the present disclosure, these descriptions should not be viewed in a restrictive or limiting sense. Rather, there are several variations and modifications which may be made without departing from the scope of the appended claims.

What is claimed is:

1. An attachment-configurable control system for a work machine, the work machine extending in a fore-aft direction, the system comprising:

a frame and a ground-engaging mechanism, the ground-engaging mechanism configured to support the frame on a surface;

a boom assembly coupled to the frame, the boom assembly having a pair of boom arms pivotally and directly connected to the frame and moveable relative to the frame by a pair of first hydraulic cylinders, and an attachment coupler coupled to a distal section of the pair of boom arms, the attachment coupler moveable relative to the frame by a pair of second hydraulic cylinders;

a hydraulic system communicatively coupled to a controller, the hydraulic system comprising a hydraulic pump coupled to one or more of the pair of first hydraulic cylinders, the pair of second hydraulic cylinders, and an auxiliary hydraulic cylinder, the auxiliary hydraulic cylinder detachably coupled to the hydraulic system and actuating an attachment hydraulically coupled to the frame through a hydraulic coupler located on the frame wherein the hydraulic coupler includes a manifold with one or more of a male connector and a female connector, the hydraulic pump delivering fluid through a plurality of flow paths, the plurality of flow paths coupled to one or more of the pair of first hydraulic cylinders, the pair of second hydraulic cylinders, and the auxiliary hydraulic cylinders;

an operator cab coupled to the frame, the operator cab comprising a user input interface, the user input interface comprising a joystick configured to move in at least a first direction wherein the first direction is the fore-aft direction, and at least a second direction wherein the second direction is transverse to the fore-aft direction; and the controller communicatively coupled to the user input interface, the user input interface enabling an operator to command movement of the attachment coupled to the boom assembly using a first movement command configuration based on coupling of a first attachment to the boom assembly, and using a second movement command configuration based on coupling of a second attachment to the boom assembly.

2. The system of claim 1, wherein the first movement command configuration comprises moving joystick in the first direction actuating the pair of first hydraulic cylinders in a raising or a lowering of the boom assembly and moving joystick in the second direction, actuating the pair of second hydraulic cylinders in pitching the first attachment upwards or downwards, and wherein the second movement command configuration comprises moving joystick in the first direction actuating the auxiliary hydraulic cylinders in lifting or lowering the second attachment, and moving joystick in the second direction comprises actuating the auxiliary hydraulic cylinders in tilting the second attachment relative to the work machine in a radial direction about the forward portion of the boom assembly.

3. The system of claim 2, wherein the controller transmits a boom lower signal to the hydraulic system configured to lower the boom assembly to the frame immediately before, and when switching to the second movement command configuration from the first movement command configuration.

4. The system of claim 2, wherein the controller transmits a soft boom lock signal to inactivate a portion of the hydraulic system related to movement of the boom arms in one or more of raising or lowering the boom assembly.

5. The system of claim 3, wherein the controller further transmits a hard boom lock signal to an actuator coupled to a hard boom lock, the hard boom lock configured to move from an unlocked position where the boom assembly is moveable to a locked position where the boom assembly is locked to the frame in the lowered position wherein the hard boom lock comprises a receiving device coupled to one of the boom assembly and the frame to receive a movable shaft coupled to one of the other boom assembly and frame.

6. The system of claim 2, wherein the second movement command configuration further comprises an infinity switch on the joystick to activate proportionality of flow to the auxiliary hydraulic cylinders enabling the operator to control one or more of the speed of tilting the attachment, and the speed of moving the attachment upwards or downwards.

7. The system of claim 1 further comprising an identification device emitting an identification signal, the identification device coupled to the attachment and communicatively coupled to the controller, wherein the controller configures to one of the first movement command configuration and the second movement command configuration based on the identification signal.

8. The system of claim 1, wherein the user input interface further comprises a toggle switch, the toggle switch enabling the operator to toggle between the first movement command configuration and the second movement command configuration.

9. The system of claim 1, wherein the user input interface further enables the operator to activate the grade control system based on coupling of the second attachment to the boom assembly.

10. The system of claim 1, wherein the second attachment is one or more of a box blade, an auger, a trencher, and a forklift.

11. A method for configuring a control system for a work machine based on an attachment coupled to the work machine, the work machine extending in a fore-aft direction and including a boom assembly, the method comprising:

coupling one of a first attachment and a second attachment to the boom assembly, the boom assembly coupled to a frame of the work machine, the boom assembly having a pair of boom arms pivotally and directly connected to the frame and moveable relative to the frame by a pair of first hydraulic cylinders, and an attachment coupler coupled to a distal section of the pair of boom arms, the attachment coupler moveable relative to the frame by a pair of second hydraulic cylinders;

detachably coupling an auxiliary hydraulic cylinder coupled to the frame through a hydraulic coupler located on the frame for actuating the attachment, wherein the hydraulic coupler includes a manifold with one or more of a male connector and a female connector;

identifying the attachment coupled to the work machine by a controller of the work machine; and enabling, by the controller on the work machine, an operator to command movement of the attachment coupled to the boom assembly using a user input interface in a first movement command configuration based on identifying the first attachment coupled to the boom assembly, and a second movement command configuration based on identifying the second attachment coupled to the boom assembly.

12. The method of claim 11 further comprising:

transmitting a boom lower signal by the controller to the hydraulic system configured to lower the boom assembly to the frame one or more of immediately before, immediately after, and when switching to the second movement command configuration from the first movement command configuration, and transmitting a soft boom lock signal by the controller to inactive a portion of the hydraulic system related to movement of the boom arms in one or more of raising and lowering of the boom assembly.

13. The method of claim 11 further comprising transmitting a hard boom lock signal to an actuator coupled to a hard boom lock, the hard_boom lock configured to move from an unlocked position where the boom assembly is moveable to a locked position where the boom assembly is locked to the frame in a lowered position, the hard boom lock comprises a receiving device coupled to one of the boom assembly and the frame to receive a movable shaft coupled to one of the other boom assembly and frame.

14. The method of claim 11 wherein identifying the attachment coupled to the work machine further comprises receiving an identification signal from an identification device coupled to the attachment, wherein the identification signal is wireless.

15. The method of claim 11 wherein the user input interface comprises a joystick configured to move in at least a first direction wherein the first direction is a fore-aft direction, and at least a second direction wherein the second direction is transverse to the fore-aft direction.

16. The method of claim 15, wherein the first movement command configuration comprises moving joystick in the first direction actuating a pair of first hydraulic cylinders coupled to the boom assembly in a raising or a lowering of the boom assembly, and in the second direction actuating a pair of second hydraulic cylinders in pitching the attachment upwards or downwards, and wherein the second command control configuration comprises moving joystick in the first direction in actuating the auxiliary hydraulic cylinders in lifting or lowering the second attachment, and moving joystick in the second direction comprises actuating the auxiliary hydraulic cylinders in tilting the second attachment relative to the work machine in a radial direction about the forward portion of the boom assembly.

17. The method of claim 11, wherein the method further comprises enabling, by the controller on the work machine, an operator to activate the grade control system based on coupling of the second attachment to the boom assembly.

18. The method of claim 11, wherein the second attachment is one or more of a box blade, an auger, a trencher, and a forklift.

19. The method of claim 11, wherein the user input interface comprises a toggle switch, the toggle switch enabling the operator to toggle between the first movement command configuration and the second movement command configuration.

20. The method of claim 11 further comprising:

adjusting an infinity switch on the user input interface to adjust the proportionality of fluid flow to the auxiliary hydraulic cylinder in relation to a joystick movement.

* * * * *